United States Patent [19]

Schnatzmeyer

[11] 4,307,902

[45] Dec. 29, 1981

[54] RISER CONNECTOR

[75] Inventor: Mark A. Schnatzmeyer, Lewisville, Tex.

[73] Assignee: Otis Engineering Corp., Dallas, Tex.

[21] Appl. No.: 57,342

[22] Filed: Jul. 13, 1979

[51] Int. Cl.[3] ..... F16L 35/00

[52] U.S. Cl. ..... 285/3; 166/214; 285/39; 285/86; 285/315; 285/319

[58] Field of Search ..... 285/39, DIG. 21, 141, 285/315, 316, 322, 86, 319, 3, 4; 166/214, 136

[56] References Cited

U.S. PATENT DOCUMENTS

| | | | |
|---|---|---|---|
| 3,071,188 | 1/1963 | Raulins | 285/DIG. 21 |
| 3,222,088 | 12/1965 | Haeber | 285/316 X |
| 3,330,341 | 7/1967 | Jackson et al. | 285/39 X |
| 3,450,421 | 6/1969 | Harwell | 285/315 X |
| 3,521,909 | 7/1970 | Brown | 285/39 X |
| 3,912,009 | 10/1975 | Davis | 285/314 |
| 3,915,226 | 10/1975 | Savage | 285/316 |
| 4,040,649 | 8/1977 | Blackwell | 285/315 |
| 4,074,912 | 2/1978 | Bilderbeck et al. | 285/39 |

*Primary Examiner*—Dave W. Arola
*Attorney, Agent, or Firm*—Vinson & Elkins

[57] ABSTRACT

The present invention discloses a riser connector assembly for connecting two riser members. The riser connector assembly includes connecting means which are remotely activated by a shifting tool. The connecting means includes a latch attached to one riser member and which engages the other riser member, a locking sleeve for holding the latch in engagement, an actuator sleeve for driving said locking sleeve to a position where it holds the latch in engagement, and locking means for locking the locking sleeve in that position. The shifting tool is attached to a tubing string or a line and lowered into the riser. The shifting tool has a first engagement means for engaging and moving the actuator sleeve and second engagement means for engaging and moving the locking sleeve. The shifting tool is used for remotely activating the connecting means in both connecting and disconnecting the riser members.

13 Claims, 8 Drawing Figures

RISER CONNECTOR

BACKGROUND OF THE INVENTION

All prior art mechanical riser connectors require manual operations at the riser joint, such as adjusting actuator bolts, in order to make the connection between the riser members. Generally, either a subsea diver is used to perform these manual operations or the connection is made at the surface and the riser is then lowered or driven into its operating position. Both of these procedures are expensive and time consuming. There are no prior art mechanical riser connectors that can be connected by remote activation.

Most prior art mechanical riser connectors also require manual operations at the riser joint in order to disconnect the riser members. However, there is one prior art mechanical riser connector that can be remotely disconnected without any manual operations at the riser joint. To disconnect this riser connector, a shifting tool is attached to the end of a tubing string and is lowered into the riser. The shifting tool engages a sleeve and slides the sleeve upward. The movement of the sleeve releases a latch that connects the riser members. Since the riser members are disconnected when the sleeve is shifted in one longitudinal direction, this riser connector is susceptible to being inadvertently disconnected with movement of any object inside the riser connector in that longitudinal direction. Examples of objects which may inadvertently shift the sleeve thereby disconnecting the riser members are pigs used to clean out the riser and tubing strings which pass through the riser. The consequences of inadvertent disconnection of the riser connector can be devastating.

SUMMARY OF THE INVENTION

The present invention discloses a riser connector comprising a first tubular member, a second tubular member which telescopes over one end of said first tubular member and remotely activated connecting means attached to at least one of the tubular members for connecting said tubular members together. The connecting means is remotely activated by a shifting tool which is insertable in the bores of said tubular members.

An object of this invention is to provide a riser connector which can be connected without manual operations at the riser joint.

Another object of this invention is to provide a riser connector which can be connected by remote mechanical activation.

A further object of this invention is to provide a riser connector which can be connected and disconnected without manual operations at the riser joint.

Yet another object of this invention is to provide a riser connector which can be connected and disconnected by remote activation.

Still yet another object of this invention is to provide a remotely activated riser connector with connecting means which can only be disconnected by movement of the connecting means first in one longitudinal direction and then in the other longitudinal direction, thereby avoiding inadvertent disconnection arising from movement of an object in one longitudinal direction inside the riser.

Another object of this invention is to provide a riser connector with connecting means which can be connected and disconnected by remote activation, but which requires movement of the connecting means first in one longitudinal direction and then in the other longitudinal direction prior to disconnection, thereby avoiding inadvertent disconnection arising from movement of an object in one longitudinal direction inside the riser.

DESCRIPTION OF THE PREFERRED EMBODIMENT

Figure 1:
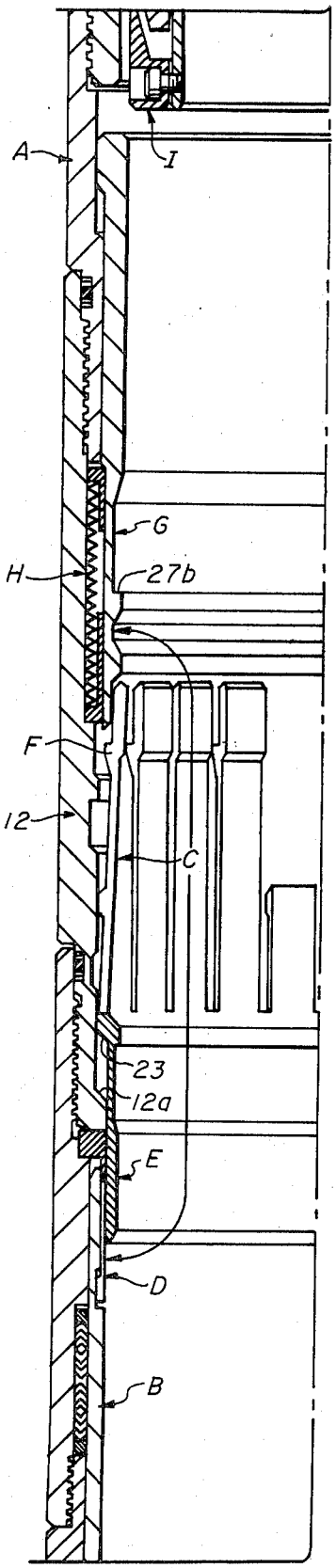
FIG. 1 is a partial cross-sectional view of the riser connector and the shifting tool prior to activation of the connecting means.
Figure 2:
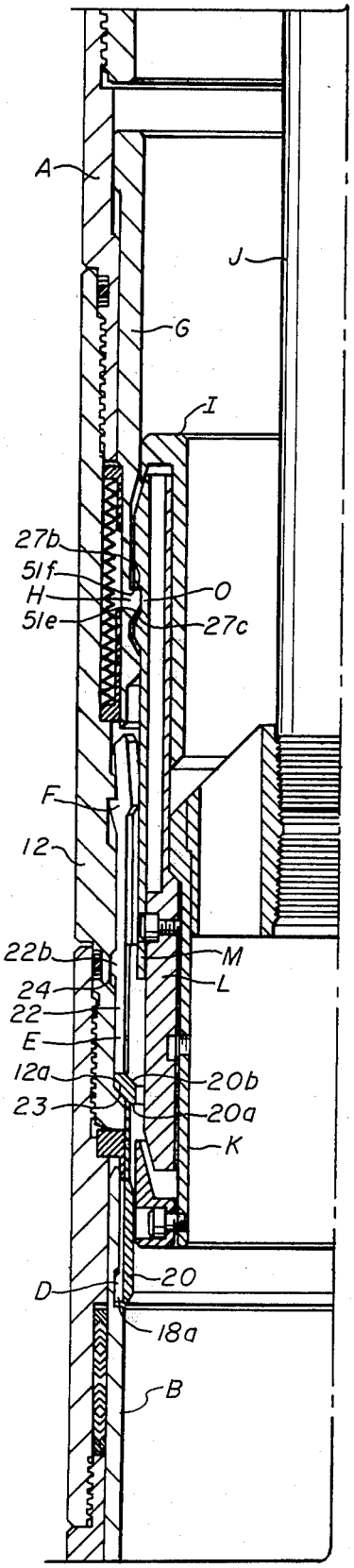
FIG. 2 is a partial cross-sectional view of the riser connector in FIG. 1 wherein the shifting tool has activated the connecting means thereby connecting the tubular members.
Figure 3:
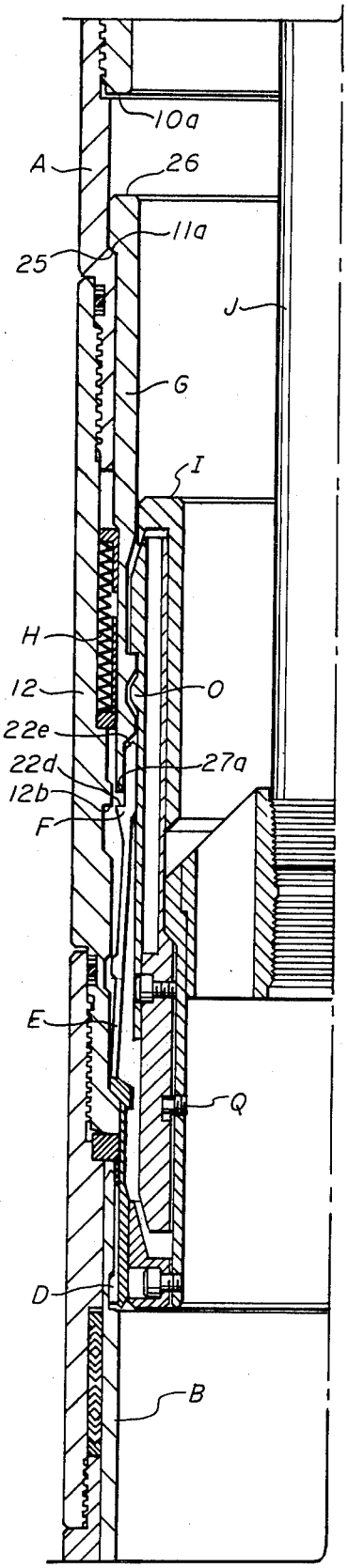
FIG. 3 is a partial cross-sectional view of the riser connector in FIG. 1 wherein the shifting tool has shifted the connecting means in one longitudinal direction prior to disconnection.
Figure 5:
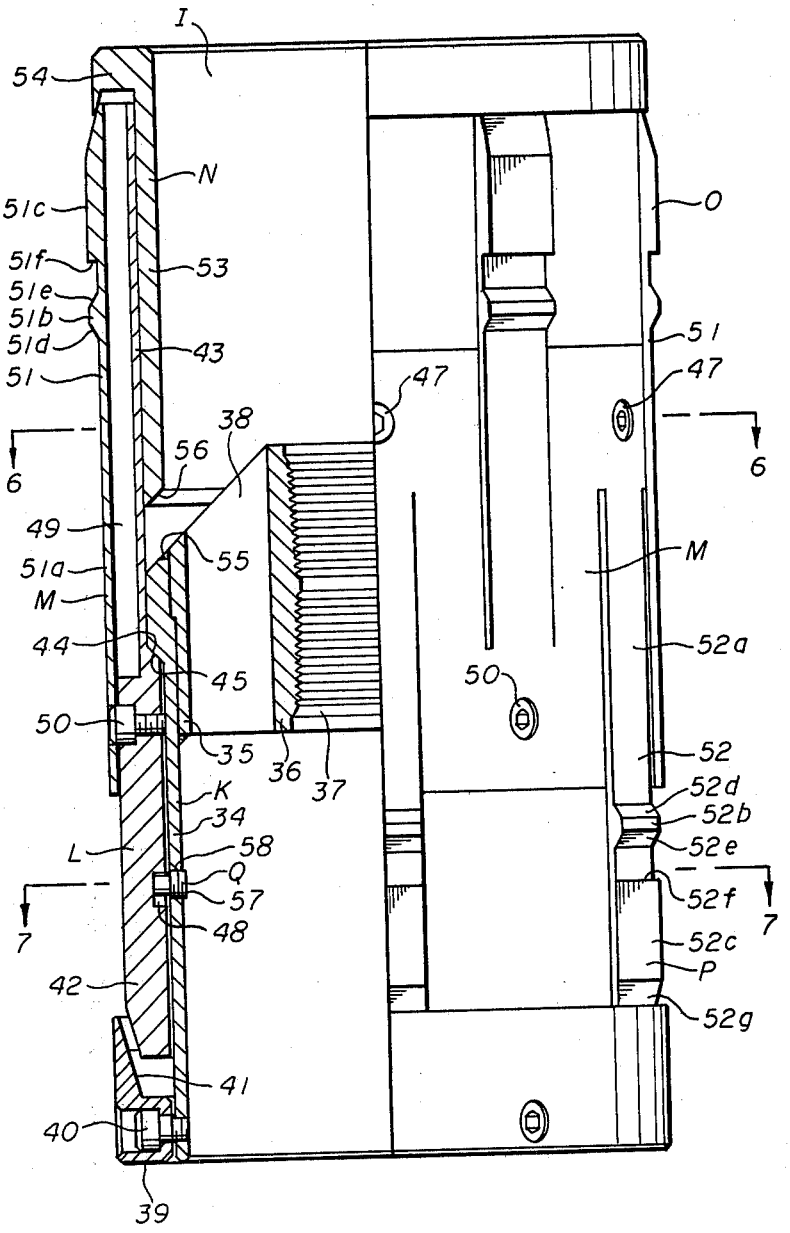
FIG. 5 is a partial cross-sectional view of the shifting tool.

As illustrated in FIG. 1, the riser connector assembly includes a first tubular member A which telescopes over a second tubular member B, and connecting means C. The connecting means C is comprised of a latch means D which connects the tubular members when held in engagement with the second tubular member B, locking sleeve E for holding the latch means D in engagement, locking means F for locking the locking sleeve E in a position where locking sleeve E holds latch means D in engagement, actuator sleeve G for moving the locking sleeve to that position and for unlocking the locking means F, and resilient urging means H for returning the actuator sleeve G to its normal position. As illustrated in FIGS. 2 and 3, the connecting means C is remotely activated by mechanical means such as shifting tool I which is attached to the end of tubing string J or to the end of a line. As illustrated in FIG. 5, the shifting tool I is comprised of an inner housing K, an outer housing L, an outer sleeve M and a retainer sleeve N. The outer sleeve M includes first rectractable engagement means O for engaging the actuator sleeve G and second retractable engagement means P for engaging the locking sleeve E. Additionally, releasable attachment means Q governs the retraction of second engagement means P.

Figure 4A:
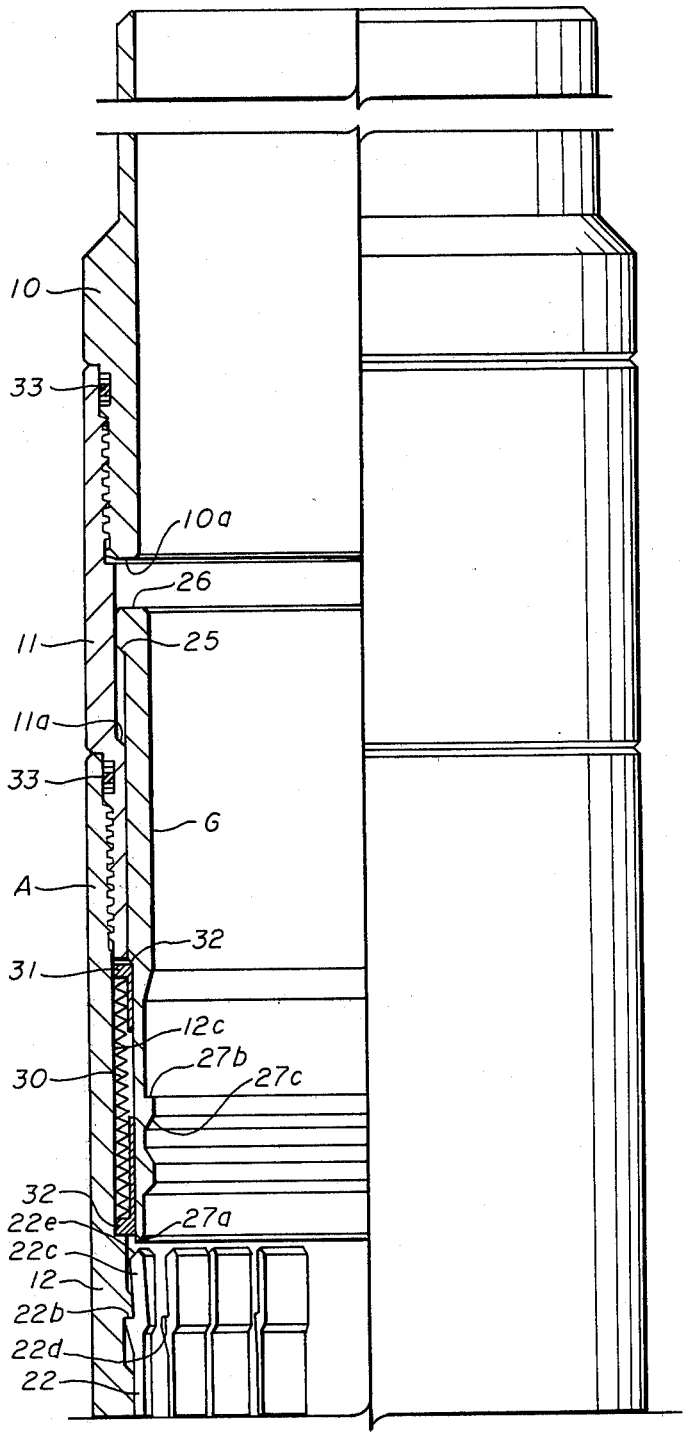
FIG. 4*a* is a partial cross-sectional view of the top of the riser connector with the riser members connected.
Figure 4B:
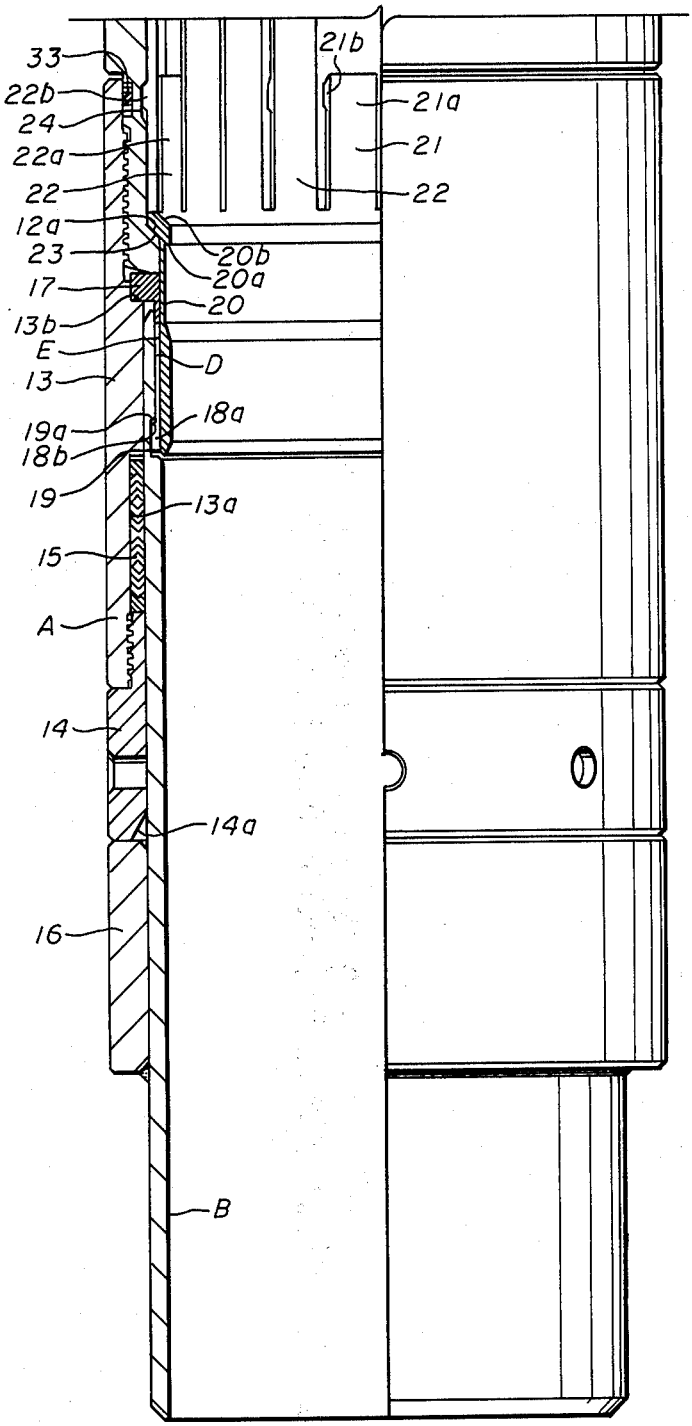
FIG. 4*b* is a partial cross-sectional view of the bottom of the riser connector with the riser members connected.

As illustrated in FIGS. 4*a* and 4*b*, the first tubular member A is comprised of tubing subs 10, 11, 12, 13 and 14 which are attached to each other by threaded connections with tubing sub 10 being the top sub and tubing sub 14 being the bottom sub. All of these tubing subs have longitudinal bores. The bottom end of tubing sub 14 has beveled inner surface 14*a* for guiding the first tubular member A over the end of the second tubular member B. Sealing means 15 in annular recess 13*a* on the interior of tubing sub 13 prevents fluid communication between the exterior and the interior of the tubular members and contains any pressure differentials between inside and outside of the assembly.

Collar 16 is attached to the exterior of the second tubular member B. Collar 16 serves as a means of limiting the telescoping movement of the first tubular member A over the second tubular member B since the first tubular member A can only move over the second tubular member B until the bottom end of tubing sub 14 abuts the top rim of collar 16.

As illustrated in FIG. 4*b*, latch means D is a tubular element having an inverted L-shaped cross-section and is within tubing sub 13. The upper part of the latch means D is a flange 17 which is retained between the lower end of tubing sub 12 and an inwardly projecting shoulder 13*b* of tubing sub 13 when tubing sub 12 is made up with tubing sub 13. The bottom part of the latch means D is comprised of a plurality of downwardly projecting flexible latch fingers 18. At the end of each latch finger 18 is an enlargement 18*a*. Each enlargement 18*a* is adapted to engage the annular groove 19 in the internal wall of the second tubular member B. The upper end 19*a* of said groove is inclined to form a shoulder which an inclined complimentary shoulder 18*b* on each latch finger 18 is adapted to engage. When the first tubular member A is positioned over the second tubular member B so that the bottom end of tubing sub 14 abuts the top rim of collar 16, the latch means D is positioned so that the shoulders 18*b* of enlargements 18*a* can be held in engagement with upper end 19*a* of the annular groove 19 by the locking sleeve E.

The locking sleeve E is a tubular member with a longitudinal bore and is generally comprised of a lower tubular element 20, collet fingers 21 and collet fingers 22. The locking sleeve E is movable within the bores of the first tubular member A and the latch means D from a first position illustrated in FIG. 1 to a second position illustrated in FIG. 2. In the second position, the lower tubular element 20 of locking sleeve E holds the latch fingers 18 in engagement with annular groove 19. Downward movement of the locking sleeve E beyond the second position is prevented by abutment of downwardly projecting shoulder 23 on the exterior of the locking sleeve E with upward projecting complimentary shoulder 12*a* on the interior of tubing sub 12. The lower tubular element 20 has an inwardly projecting downwardly facing square shoulder 20*a* and an inwardly projecting upwardly facing tapered shoulder 20*b* on its interior bore for engaging shifting tool I.

As illustrated in FIGS. 4*a* and 4*b*, collet fingers 21 are shorter than collet fingers 22. The reason for the difference in the lengths will be hereinafter explained during the discussion of the operation of the locking means F. Each collet finger 21 is formed by an upwardly extending flexible shank 21*a* having an enlargement 21*b* at its upper end. Each enlargement 21*b* is adapted to engage annular groove 24 in the internal wall of tubing sub 12 when the locking sleeve E is in its second position.

The locking means F is comprised of upper collet fingers 22 and downwardly projecting inwardly extending square shoulder 12*b* on the interior of tubing sub 12. Each upper collet finger 22 is formed by an upwardly extending shank 22*a* having an enlargement 22*b* at its mid-section and another enlargement 22*c* at its upper end. Each enlargement 22*b* is similar to the enlargements 21*b* in that the enlargements 22*b* are also adapted to engage annular groove 24 when the locking sleeve E is in its second position. Each enlargement 22*c* has an upwardly projecting outwardly extending square shoulder 22*d* on its exterior which is adapted to engage square shoulder 12*b* of tubing sub 12 when locking sleeve E is in its second position. The upper end of each enlargement 22*c* has an outwardly facing beveled edge 22*e*.

The actuator sleeve G is a tubular member with a longitudinal bore. The actuator sleeve G is located inside the tubing subs 12 and 13 and is movable therein to the extended position as illustrated in FIG. 3. Movement of the actuator sleeve G beyond the extended position is limited by abutment of downwardly facing outward projecting shoulder 25 on flange 26 on the top of the actuator sleeve G with upwardly facing inwardly projecting shoulder 11*a* of tubing sub 11. Movement of the actuator sleeve G in the other longitudinal direction is limited by abutment of the flange 26 of the actuator sleeve G with the lower end 10*a* of tubing sub 10. The lower end of actuator sleeve G has an inwardly facing beveled edge 27*a*. The inner bore of actuator sleeve G has an upwardly projecting inwardly extending square shoulder 27*b* and a downwardly projecting inwardly extending tapered shoulder 27*c* for engaging shifting tool I.

The resilient urging means H is comprised of a plurality of springs 29, upper spring guide ring 30 and lower spring guide ring 31. The resilient urging means H preferably urges the actuator sleeve G to its normal position illustrated in FIG. 4*a*. The resilient urging means H is housed in the annular chamber between the recess 12*c* on interior of tubing sub 12 and the exterior of the actuator sleeve G. When the actuator sleeve G is moved from its normal position to its extended position by shifting tool I, downwardly facing outwardly projecting shoulder 32 on the exterior of actuator sleeve G engages the top of upper spring guide 30 and drives upper spring guide ring 30 downward thereby compressing the plurality of springs 29.

Conventional seal elements 33 located between tubing subs 10 and 11, between tubing subs 11 and 12, and between tubing subs 12 and 13 prevent fluid communication between the interior and exterior of the riser members.

As previously discussed, the present invention is activated by shifting tool I. The shifting tool I illustrated in FIGS. 1, 2 and 3 is connected to the end of the tubing string J. However, the shifting tool I could also be connected to a wire line or an electric line instead of being connected to a tubing string.

As illustrated in FIG. 5, the inner housing K of shifting tool I includes tubular body 34 which is attached to the spider 35. Spider 35 is in turn attached to a smaller tubular member 36 in which threads 37 are formed for attaching the shifting tool I to the tubing string or line. Spider 35 has a plurality of passageways 38 to allow fluid passage when the shifting tool I is run thereby avoiding swabbing effects. A release ring 39 is attached by plurality of bolts 40 to the lowermost end of tubular body 34. The release ring 39 has an inwardly protruding, upwardly facing shoulder 41 for camming the second engagement means P as will hereinafter be described.

The outer housing L is a cylindrical member with a longitudinal bore which fits over the exterior of tubular body 34. The outer housing L has a lower tubular member 42, an upper tubular member 43, and an inwardly protruding upwardly facing shoulder 44 along its interior bore which compliments an outwardly protruding downwardly facing shoulder 45 on the exterior of tubular body 34. Upward movement of the outer housing L relative to the tubular body 34 is limited by the abutment of shoulders 44 and 45.

Figure 7:
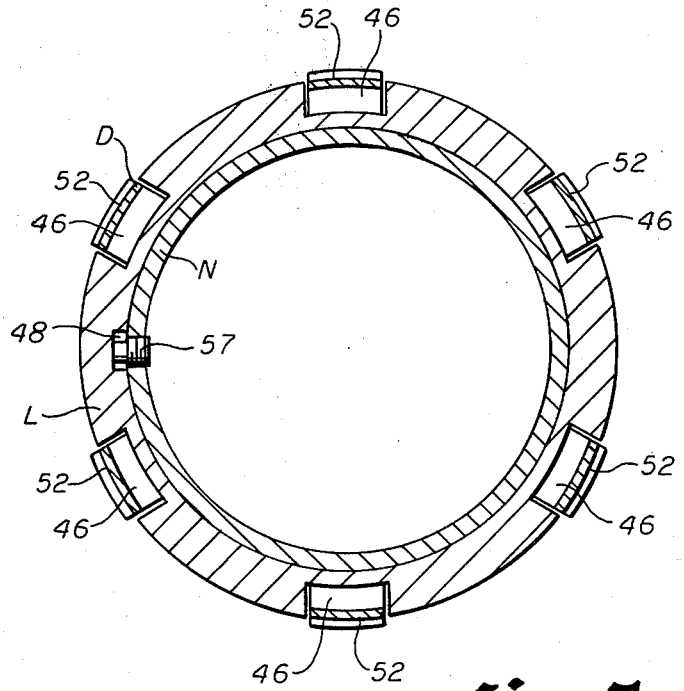
FIG. 7 is a cross-sectional view of the shifting tool taken on line 7—7.

The lower tubular member 42 of outer housing L has a plurality of longitudinal grooves 46 on its outer surface which can be seen in FIG. 7. The grooves 46 start at the bottom of lower tubular member 42 and terminate below the plurality of bolts 47 which attach the outer sleeve M to the outer housing L and retainer sleeve N. Annular recess 48 is on the interior bore of the tubular member 42.

Figure 6:
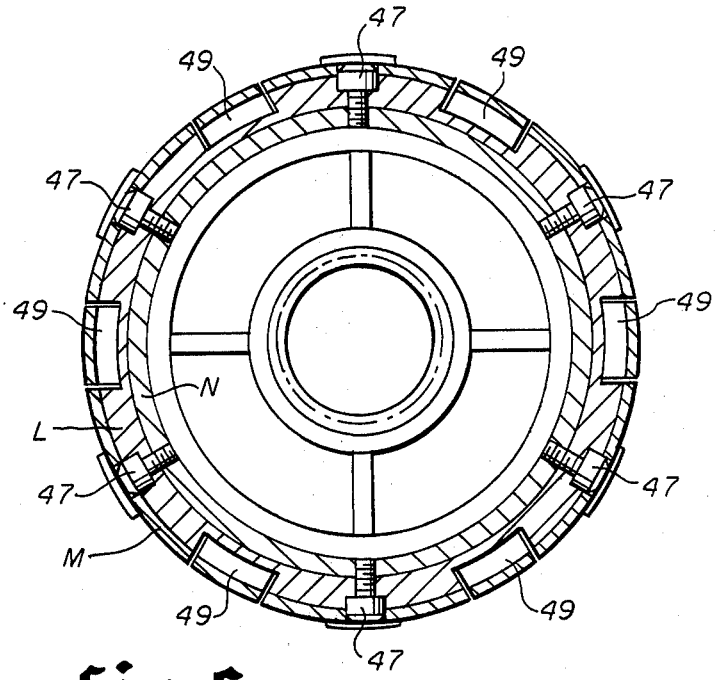
FIG. 6 is a cross-sectional view of the shifting tool taken on line 6—6.

The upper tubular member 43 also has a plurality of longitudinal grooves 49 on its outer surface as can be seen in FIGS. 5 and 6. The grooves 49 are offset from the grooves 46. The grooves 49 start at the top of upper tubular member 43 and terminate above the plurality of bolts 50 which attach the outer sleeve M to the outer housing L.

Outer sleeve M fits over the outer housing L. As previously discussed, bolts 50 attach the outer sleeve M to the outer housing L. Additionally, as illustrated in FIG. 6, bolts 47 attach the outer sleeve M to both the outer housing L and retainer sleeve N. The upper part of the outer sleeve M is comprised of a plurality of retractable collet fingers 51 which form the first engagement means O. Each collet finger 51 is formed by an upwardly extending shank 51*a* having an enlargement 51*b* at its mid-section and another enlargement 51*c* at its upper end. Enlargement 51*b* has a lower tapered shoulder 51*d* and an upper tapered shoulder 51*e*. Shoulder 51*e* is adapted to engage shoulder 27*c* of actuator sleeve G. Enlargement 51*c* has a downwardly facing square shoulder 51*f* which is adapted to engage shoulder 27*b* of actuator sleeve G. (See FIG. 2). When the outer sleeve M has been attached to the outer housing L, each collet finger 51 is over one of the longitudinal grooves 49 of the outer housing L. Any force directed at the axis of the shifting tool I applied to the collet fingers 51 will collapse the collet fingers 51 into the grooves 49. For example, after the collet fingers 51 have engaged the actuator sleeve G, an upward force applied to the shifting tool I will cause tapered shoulder 27*c* of the actuator sleeve G to cam collet fingers 51 inward thereby freeing the shifting tool I from the actuator sleeve G.

The lower part of outer sleeve M is comprised of a plurality of retractable collet fingers 52 which form the second engagement means P. Each collet finger 52 is formed by a downwardly extending shank 52*a* having an enlargement 52*b* at its mid-section and another enlargement 52*c* at its lower end. Enlargement 52*b* has an upper tapered shoulder 52*d* and a lower tapered shoulder 52*e*. Enlargement 52*c* has an upwardly facing outwardly extending square shoulder 52*f* adapted for engagement with shoulder 20*a* of the locking sleeve E when shifting tool I is in the position illustrated in FIG. 3. When the outer sleeve M has been attached to the outer housing L, each collet finger 52 is over one of the longitudinal grooves 46. Any inward directed force on the collet fingers 52 will collapse the collet fingers 52 into the grooves 46. At the lowermost exterior of each collet finger 52 is outwardly facing tapered surface 52*g*.

The retainer sleeve N is attached to the outer sleeve M and the outer housing L by bolts 50. Retainer sleeve N is a tubular member having an inverted L-shaped cross-section with the elongated sleeve member 53 fitting inside the upper part of outer housing L. The top of the retainer sleeve N is comprised of flange 54. The lower interior edge of retainer sleeve N is an inwardly beveled surface 55 for abutting complimentary outwardly facing surface 56 on the top exterior of tubular body 34 of inner housing K.

The selectively releasable attachment means Q is comprised of frangible pin 57 which is attached to a threaded port 58 in the middle part of the lower tubular member 42 of the outer housing L adjacent to annular recess 48. The non-threaded end of pin 57 fits into annular recess 48. With pin 57 in place, the outer housing L, along with the connected outer sleeve M and retainer sleeve N, cannot move relative to the inner housing K. However, with the pin 57 either not in place or sheared, the outer sleeve M and attached members can move relative to the inner housing K. When the pin 57 is removed or sheared, any downward force applied to collet fingers 52 relative to inner housing K will drive the collet fingers 52, the outer sleeve M and attached members downward relative to the inner housing K. This movement will result in tapered surface 52*g* contacting shoulder 41 of release ring 39, thereby camming collet fingers 52 inward. The downward movement of the outer sleeve M and attached members is limited by the abutment of the lower inwardly beveled surface 55 of the retainer sleeve N with the outwardly facing surface 56 of the tubular body 34 of inner housing K.

OPERATION

Second tubular member B is attached to a subsea fixture with one end projecting upwards. The connecting means C and first tubular member A are assembled and then lowered into place. The beveled surface 14*a* on the bottom of tubing sub 14 aids in guiding the first tubular member A over the upward projecting end of the second tubular member B. As illustrated in FIGS. 4A and 4B, the first tubular member A will telescope over the second tubular member B until the bottom end of tubing sub 14 of the first tubular member A abuts the top rim of collar 16 on the exterior of the second tubular member B. When tubing sub 14 abuts collar 16, enlargements 18*a* of latch fingers 18 are flexibly disposed within the annular groove 19 of the second tubular member B. However, the latch fingers 18 are not securely connecting the tubular members since any upward force applied to the first tubular member A will cause the latch fingers 18 to contract and disengage from the annular groove 19.

When the tubular member A is made up at the surface, the locking sleeve E is positioned so that the collet fingers 22 are contracted within the actuator sleeve G. As illustrated in FIG. 1, the locking sleeve E remains in this position until activated by the shifting tool I. In this position, the lower tubular element 20 of the locking sleeve E is above the latch fingers 18 of the latch means D. Therefore, when the tubular member A is lowered into place, the latch fingers 18 are free to be contracted as the latch fingers 18 come into contact with the inner surface of the upper end of the second tubular member B. The latch fingers 18 will expand when the latch finger enlargements 18*a* are positioned adjacent to annular groove 19.

After the first tubular member A is lowered into position, the shifting tool I is attached to a tubing string or line by threads 37. When connecting the tubular members, the shifting tool I is assembled without pin 57.

The shifting tool I is then lowered into the first tubular member A. While lowering the shifting tool I, the operator can monitor weight indication at the surface to determine the various stages of engaging and connecting the tubular members. The shifting tool I will pass through the riser member A since the camming action of shoulders 51*d* and 52*g* with the bore of the riser member A will depress the collet fingers 51 and 52 into the grooves until the shoulders 51*f* of the collet fingers 51 engage the shoulders 27*b* of the actuator sleeve G. Continued lowering of the shifting tool I after engagement with actuator sleeve G will cause the actuator sleeve G to drive the locking sleeve E downward and compress springs 29. As illustrated in FIG. 2, the downward movement of the the locking sleeve E will continue until locking sleeve E has moved to its second position and the shoulder 23 of the locking sleeve E abuts shoulder 12*a* of the tubing sub 12. The abutment of these two shoulders will show a decrease in the weight carried by the tubing string on the line. When these two shoulders abut, the lower tubular element 20 of the locking sleeve E will have moved down along the interior bore of the latch finger 18 holding enlargements 18*a* into engagement with annular groove 19. At the same time, the shoulders 22*d* on collet fingers 22 are aligned with matching shoulder 12*b* of tubing sub 12. Additionally, with the locking sleeve E in its second position the collet fingers 52 of the shifting tool I will engage the shoulders 20*a* and 20*b* of the locking sleeve E.

Once the locking sleeve E has been moved to the second position illustrated in FIG. 2, the shifting tool I is pulled upward. Since the outer housing L is not connected by pin 57 to inner housing K, the collet fingers 52 of outer sleeve M and the attached outer housing L will move downward relative to the remainder of the shifting tool I as the shifting tool I is moved upward. As collet fingers 52 move downward, tapered surface 52*g* contacts shoulder 41 of release ring 39 thereby camming the collet fingers 52 inward into grooves 49. The inward movement of collet finger 52 releases collet fingers 52 from the locking sleeve E without moving the locking sleeve E upward.

At the same time the collet fingers 52 are moving downward relative to the upward moving shifting tool I, the springs 29 begin to return the actuator sleeve G from its extended position to its normal position. As the actuator sleeve G returns to its normal position, the locking sleeve E remains stationary. As the edge 27*a* of the actuator sleeve G frees the edge 22*e* of collet fingers 22, collet fingers 22 expand outward. This expansion results in engagement of shoulder 22*d* of collet fingers 22 with shoulder 12*b* of tubing sub 12 thereby locking the locking sleeve E as illustrated in FIG. 2.

When the locking sleeve E is locked, the locking sleeve E cannot be moved in either longitudinal direction. Downward force applied to the locking sleeve E will not move the locking sleeve E since movement is precluded by the abutment of shoulder 23 of the locking sleeve E with the shoulder 12*a* of tubing sub 12. Upward force applied to the locking sleeve E will not move the locking sleeve E upward since upward movement is precluded by the engagement of shoulder 12*b* of tubing sub 12 with the shoulder 22*d* of the collet fingers 22. Therefore, any one directional force applied to the locking sleeve E will not release the latch means D.

After the shifting tool I releases the locking sleeve E and as it moves upward, the camming action between the shoulder 51*e* of collet fingers 51 of shifting tool I with shoulder 27*c* of actuator sleeve G will result in contraction of the collet fingers 51 thereby releasing shifting tool I from actuator sleeve G. The shifting tool I is then free to be removed from the riser.

To disconnect the riser connector, the shifting tool I is assembled with shear pin 51 in place. The shifting tool I is then connected to a tubing string or line by threads 37 and lowered into the tubular member A. The shifting tool I is lowered until the collet fingers 51 engage the shoulder 27*b* of the actuator sleeve G. Continued lowering of the shifting tool I after engagement will cause the actuator sleeve G to move downward and to compress springs 29. As actuator sleeve G is moved downward, beveled edge 27*a* at the bottom of actuator sleeve G contacts the beveled edge 22*e* at the top of enlargement 22*c* of collet fingers 22. As illustrated in FIG. 3, continued downward movement of actuator sleeve G will cause collet fingers 22 to contract inward due to the camming action of beveled edge 26 of actuator sleeve G with the beveled edge 22*e* of collet fingers 22. Sufficient contraction of collet fingers 22 will unlock the locking sleeve E by disengaging shoulder 22*d* of the collet fingers 22 with shoulder 12*b* of tubing sub 12. Since short collet fingers 21 offset collet fingers 22, the problem of the adjacent collet fingers 22 abutting each other and thereby precluding proper contraction of the collet fingers and unlocking the locking means F is minimized.

As illustrated in FIG. 3, the actuator sleeve G will continue to be moved downward by the shifting tool I until shoulder 25 of actuator sleeve G abuts shoulder 11*a* of tubing sub 11. At this point, a weight decrease will be indicated to the operator of the shifting tool I. When the actuator sleeve G has moved downward to this position, collet fingers 52 will engage shoulders 20*a* and 20*b* of locking sleeve E.

The shifting tool I is then moved upward in the riser. As the shifting tool I is pulled upward, the locking sleeve E and the actuator sleeve G move upward. Upward movement of the locking sleeve E will continue until the lower tubular element 20 of locking sleeve E is moved to a position above latch fingers 18. Since the lower tubular element 20 is no longer adjacent to latch fingers 18, latch fingers 18 are free to be contracted inward and the tubular members can be disconnected.

The actuator sleeve G is carried upward by the movement of the locking sleeve E and shifting tool I until the flange 26 of the actuator sleeve G abuts the lower end 10*a* of tubing sub 10 which precludes any further upward movement of the actuator sleeve G or the locking sleeve E. Continued upward force applied to the shifting tool I will be transmitted to lower end 10*a* through the actuator sleeve G and the locking sleeve E until shear pin 57 shears. Once the pin 57 is sheared, the collet fingers 52 and attached outer sleeve M can move downward relative to the remainder of the shifting tool I. As collet fingers 52 move downward, tapered surface 52*g* contacts shoulder 41 of release ring 39 thereby camming the collet fingers 52 inward releasing the shifting tool I from the locking sleeve E. The collet fingers 51 of the first engagement means O are also contracted by the camming action between the shoulder 51*e* of the collet fingers 51 and the shoulder 27*c* of the actuator sleeve G so that the shifting tool I becomes free of the actuator sleeve G. After the shifting tool I is removed from the riser, riser member A can be removed from riser member B.

What is claimed is:

1. A riser connector comprising:
a first tubular member;
a second tubular member which telescopes over one end of said first tubular member;
an annular groove on the interior of one of said tubular members;
latch means attached to the other of said tubular members for securely engaging said annular groove thereby connecting said tubular members;
a locking sleeve on the interior of one of the tubular members for holding said latch means in secure engagement with said annular groove, said locking sleeve being longitudinally movable from a first position wherein said locking sleeve does not hold said latch means in secure engagement with said annular groove to a second position wherein said locking sleeve does hold said latch means in secure engagement with said annular groove;
locking means on said locking sleeve and on one of said tubular members for locking said locking sleeve in its second position; and
an actuator sleeve for driving said locking sleeve to its second position and for unlocking said locking sleeve, said actuator sleeve being longitudinally movable within one of said tubular members to an extended position.

2. The riser connector claimed in claim 1 including resilient means for preferentially urging said actuator sleeve away from its extended position and to a normal position.

3. The riser connector claimed in claim 1 wherein the direction of movement of said actuator sleeve from its normal position to its extended position is opposite the direction of movement of said locking sleeve from its second position to its first position so that in order to disconnect the tubular members once said locking sleeve is locked in its second position, said actuator sleeve must be moved in one longitudinal direction from its normal position to its extended position to unlock said locking sleeve prior to moving said locking sleeve in the other longitudinal direction.

4. A riser connector assembly comprising:
a first tubular member having a longitudinal bore;
a second tubular member which telescopes over one end of said first tubular member having a longitudinal bore;
an annular groove on the interior of one of said tubular members;
latch means attached to the other of said tubular members for securely engaging said annular groove thereby connecting said tubular members;
a locking sleeve in the interior of tubular members for holding said latch means in secure engagement with said annular groove, said locking sleeve being longitudinally movable from a first position wherein said locking sleeve does not hold said latch means in secure engagement with said annular groove to a second position wherein said locking sleeve does hold said latch means in secure engagement with said annular groove;
locking means on said locking sleeve and on one of said tubular members for locking said locking sleeve in its second position;
an actuator sleeve for driving said locking sleeve to its second position and for unlocking said locking sleeve, said actuator sleeve being longitudinally movable within one of said tubular members to an extended position;
resilient means for preferentially urging said actuator sleeve away from its extended position and to a normal position; and
a shifting tool for engaging and moving said actuator sleeve to its extended position;
said shifting tool also for engaging and moving said locking sleeve from its second position to its first position.

5. The riser connector assembly claimed in claim 4 including sealing means between said tubular members.

6. The riser connector assembly claimed in claim 4 including means for limiting the amount that said second tubular member telescopes over the first tubular member.

7. The riser connector assembly in claim 4 wherein said shifting tool includes:
an outer housing with a longitudinal bore;
first engagement means on said outer housing for engaging said actuator sleeve whereby movement of said outer housing in one longitudinal direction after said engagement moves said actuator sleeve from its normal position to its extended position and movement of said housing in the other longitudinal direction after said engagement releases said first engagement means from said actuator sleeve.

8. The riser connector assembly in claim 7 wherein said shifting tool includes second engagement means on said housing for engaging said locking sleeve and moving said locking sleeve from its second position to its first position.

9. The riser connector assembly claimed in claim 8 wherein said shifting tool includes:
an inner housing inside said outer housing and longitudinally movable therewith;
means for limiting the longitudinal movement of said inner housing relative to said outer housing; and
means for attaching said inner housing to a tubing string or a line.

10. The riser connector assembly claimed in claim 9 wherein said shifting tool includes:
releasable attachment means for preventing longitudinal movement of said outer housing relative to said inner housing until said locking sleeve has been moved from its second position to its first position; and
camming means for inwardly contracting said second engagement means and thereby disengaging said second engagement means from said locking sleeve after said releasable attachment means has been released.

11. The riser connector assembly claimed in claim 10 wherein said releasable attachment means is a frangible shear pin.

12. The riser connector assembly claimed in claim 11 including means for releasing said attachment means after said shifting tool has moved said locking sleeve from its second position to its first position.

13. A riser connector comprising:
a first tubular member;
a second tubular member which telescopes over one end of said first tubular member;
remotely activated connecting means attached to at least one of said tubular members for connecting said tubular members together wherein said connecting means is remotely activated for both connecting and disconnecting the tubular members, and wherein said connecting means is movable first in one longitudinal direction and then in the other longitudinal direction in order to disconnect the tubular members;

said connecting means including an annular groove on the interior of one of said tubular members;

said connecting means also including latch means attached to the other of said tubular members for securely engaging said annular groove thereby connecting said tubular members;

said connecting means also including a locking sleeve on the interior of one of the tubular members for holding said latch means in secure engagement with said annular groove, said locking sleeve being longitudinally movable from a first position wherein said locking sleeve does not hold said latch means in secure engagement with said annular groove to a second position wherein said locking sleeve does hold said latch means in secure engagement with said annular groove; and locking means on said locking sleeve and on one of said tubular members for locking said locking sleeve in its second position.

* * * * *